United States Patent [19]

Ishida et al.

[11] Patent Number: 4,807,931

[45] **Date of Patent: * Feb. 28, 1989**

[54] AIR-CONTROLLED LUMBAR SUPPORT DEVICE

[75] Inventors: Keiichi Ishida, Toyota; Kuniyoshi Harada, Takahama, both of Japan

[73] Assignee: Aisin Seiki Co., Ltd., Kariya, Japan

[ * ] Notice: The portion of the term of this patent subsequent to Feb. 18, 2003 has been disclaimed.

[21] Appl. No.: 6,276

[22] Filed: Jan. 20, 1987

Related U.S. Application Data

[63] Continuation of Ser. No. 756,675, Jul. 19, 1985, abandoned.

[30] Foreign Application Priority Data

Jul. 20, 1984 [JP] Japan ..... 59-110385

[51] Int. Cl.[4] ..... A47C 7/46

[52] U.S. Cl. ..... 297/284; 297/DIG. 3; 137/115

[58] Field of Search ..... 297/284, DIG. 3; 137/115

[56] References Cited

U.S. PATENT DOCUMENTS

| | | | |
|---|---|---|---|
| 2,731,652 | 1/1956 | Bishop | 297/DIG. 3 X |
| 2,826,767 | 3/1958 | Edwards | 5/441 |
| 4,016,895 | 4/1977 | Budecker | 137/115 X |
| 4,491,364 | 1/1985 | Hattori et al. | 297/DIG. 3 X |
| 4,491,629 | 4/1984 | Mackal | 137/115 X |
| 4,516,788 | 5/1985 | Umetsu et al. | 297/284 X |
| 4,570,676 | 2/1986 | Nishio et al. | 297/284 X |

*Primary Examiner*—Kenneth J. Dorner
*Assistant Examiner*—Peter R. Brown
*Attorney, Agent, or Firm*—Finnegan, Henderson, Farabow, Garrett & Dunner

[57] ABSTRACT

An air-controlled lumbar support apparatus for a vehicle seat having a base member and a backrest is provided and includes an inflatable chamber, a valve mechanism, and a pneumatic tube. The inflatable chamber is mounted within the backrest and includes at least one partition disposed across a substantial portion of the at least one inflatable chamber. The valve mechanism receives and discharges a flow of pressurized fluid. The pneumatic tube interconnects the valve mechanism and the inflatable chamber for transferring the flow of pressurized fluid. A pump is attached to the valve mechanism for injecting fluid through the valve mechanism and the pneumatic tube to inflate the inflatable chamber. A switching mechanism allows for the release of fluid out of the valve mechanism, thereby deflating the inflatable chamber, as desired.

3 Claims, 3 Drawing Sheets

AIR-CONTROLLED LUMBAR SUPPORT DEVICE

This application is a continuation, of application Ser. No. 756,675, filed July 19, 1986, now abandoned.

BACKGROUND OF THE INVENTION

1. Field of the Invention

The present invention relates to an air-controlled support for a vehicle seat and, more particularly, to an air-controlled lumbar support apparatus for use in a vehicle seat.

2. Description of the Prior Art

A conventional air-controlled lumbar support apparatus is disclosed in U.S. patent application Ser. No. 4,190,286 to Bentley. An example of the conventional apparatus is shown generally in FIG. 1 and includes a vehicle seat 10 with a backrest 12 having a series of inflatable chambers 14. Each of the inflatable chambers 14 is connected to a valve mechanism 16 by individual tubes 18. The valve mechanism 16 controls the intake and exhaust of the air within the inflatable chambers 14. Additional air is supplied to the inflatable chambers 14 by means of an air pump 20, which delivers the air supply through the valve mechanism 16.

Since several inflatable chambers 14 are installed within the backrest 12 of the seat 10, the valve mechanism 16 requires a series of valves (not shown) for controlling the intake and exhaust of air to the inflatable chambers 14. As a result, the valve mechanism 16 typically is oversized and unduly complicated. Furthermore, the valve mechanism 16 and the air pump 20 must be independently mounted on the seat 10. Therefore, considerable space is required to position the tubes 18, the valve mechanism 16, the inflatable chambers 14 and the air pump 19 in reasonable proximity to each other.

SUMMARY OF THE INVENT

Accordingly, it is an objective of the invention to provide an air-controlled lumbar support apparatus with improved operating characteristics, which is very accessible to the seated passenger.

It is also an objective of the invention to provide an air-controlled lumbar support apparatus in which the air pump is directly mounted on the valve mechanism.

It is another objective of the invention to provide an air-controlled lumbar support apparatus which is not constrained by a series of tubes extending to and from the valve mechanism.

Additional objectives and advantages of the present invention will be set forth in the description that follows and in part will be obvious from the description or may be learned by practice of the invention. The objectives and advantages may be realized by the apparatus as particularly pointed out in the appended claims.

To achieve the foregoing objectives and in accordance with the purpose of the invention, as embodied and broadly described herein, the air-controlled lumbar support device for a vehicle seat having a base member and a backrest comprises an inflatable chamber, valve means and a pneumatic tube. The inflatable chamber is mounted within the backrest and includes at least one partition plate disposed across a substantial portion of the at least one inflatable chamber. The valve means receives and discharges a flow of pressurized fluid. A pneumatic tube for transferring the flow of pressurized fluid interconnects the valve means and the inflatable chamber. The lumbar support device also includes pump means, which are attached to the valve means, for injecting fluid through the valve means and the pneumatic tube to inflate the inflatable chamber. Switch means are also provided for releasing fluid out of the valve means to deflate the inflatable chamber.

The present invention preferably includes conduit means for passing the flow of pressurized fluid between the pump means and the pneumatic tube. A check valve is seated within the conduit means for restricting the flow of pressurized fluid from the inflatable chamber. A relief valve may be integrally connected to the switch means and slidably positioned within the conduit means for unseating the check valve to exhaust the pressurized fluid from the inflatable chamber. The valve means may also include a secondary relief valve for reducing the pressure within the conduit means if it exceeds a predetermined value. Preferably, the valve means is rigidly attached to the base member of the vehicle seat.

The accompanying drawings, which are incorporated in and constitute part of the specification, illustrate the preferred embodiments of the invention and, together with the description, serve to explain the principles of the invention.

DESCRIPTION OF THE PREFERRED EMBODIMENT

Figure 1:
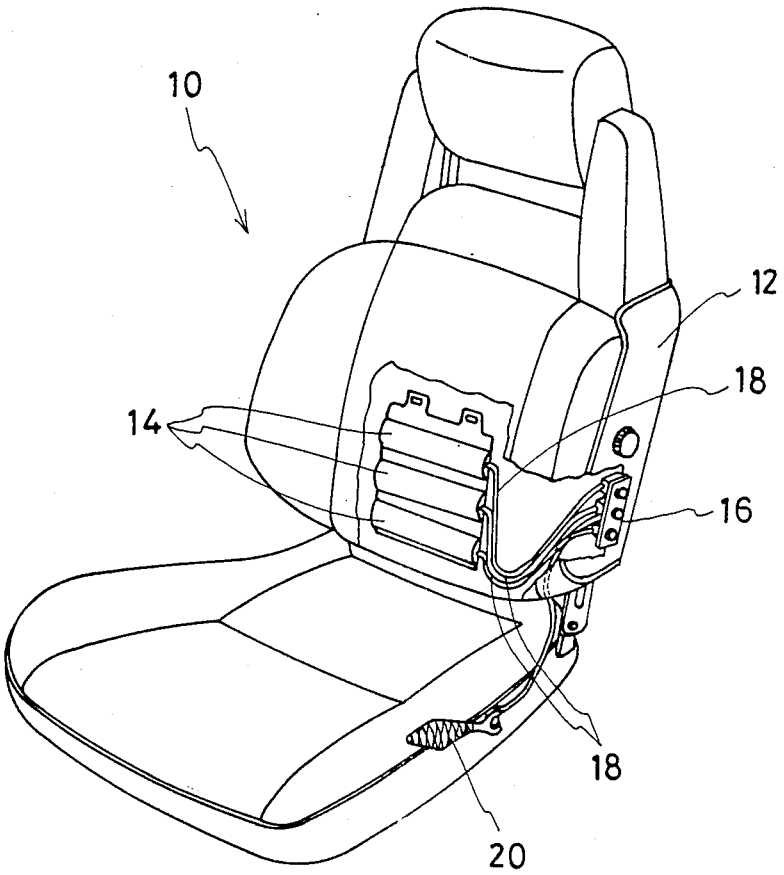
PRIOR ART Fig. 1
FIG. 1 is a perspective view of a conventional air-controlled lumbar support apparatus with the lumbar portion in partial section.
Figure 2:
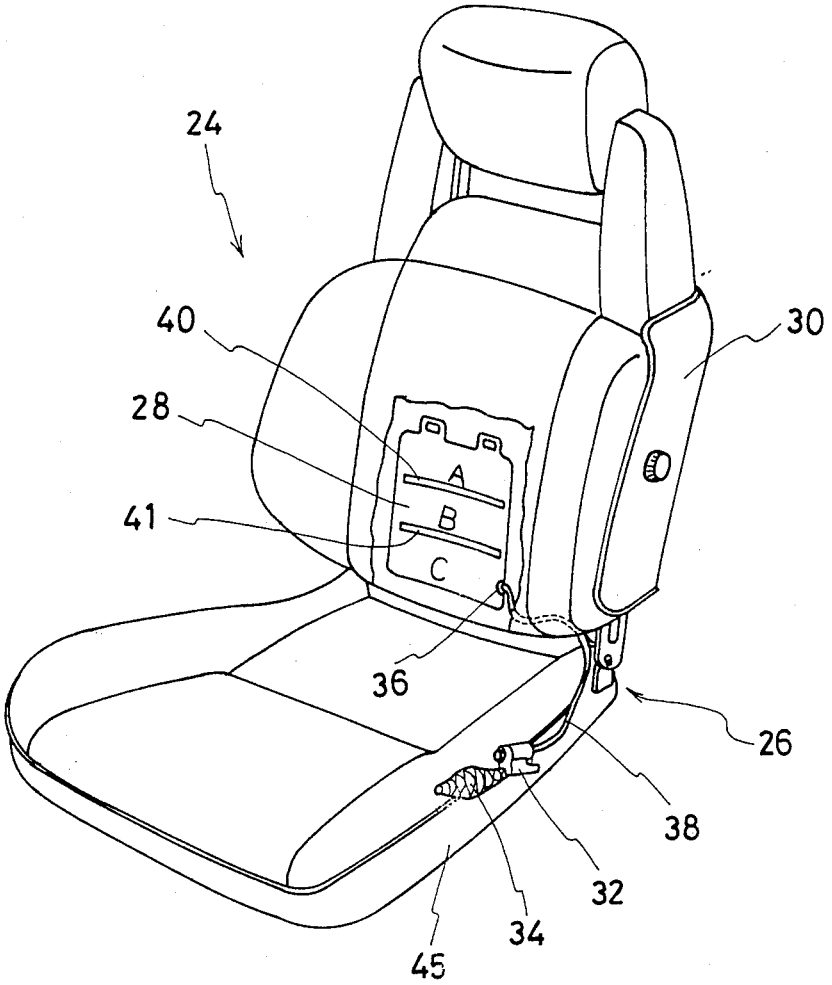
FIG. 2 is a perspective view of an air-controlled lumbar support apparatus of the present invention with the lumbar portion in partial section.

In accordance with the present invention, as shown in FIG. 2, a vehicle seat 24 is provided with an air-controlled lumbar support apparatus, which is generally designated by the reference numeral 26. As embodied herein, the vehicle seat 24 includes a single inflatable chamber 28 installed within a backrest 30 of the seat 24. The air-controlled lumbar support apparatus 26 includes a valve mechanism 32 for controlling the intake and exhaust of the air within the inflatable chamber 28. An air pump 34 supplies air to the inflatable chamber 28 through the valve mechanism 32.

The inflatable chamber 28 includes an inlet portion 36 for receiving a tube 38, which is connected to the valve mechanism 32. The inflatable chamber 28 also contains partitions 40, 41 which extend in parallel across a substantial portion of the inflatable chamber 28. The partitions 40, 41 divide the inflatable chamber 28 into three separate but interconnected sections A, B and C. Air is communicated between adjacent sections at the ends of the partitions 40, 41. The inflatable chamber 28 is expanded by a supply of air transmitted through the inlet portion 26, which is attached to section C. The division of the inflatable chamber 28 into sections A, B and C allows even expansion and selected support for the lumbar portion of the seated passenger, even though only one chamber is used.

Figure 3:
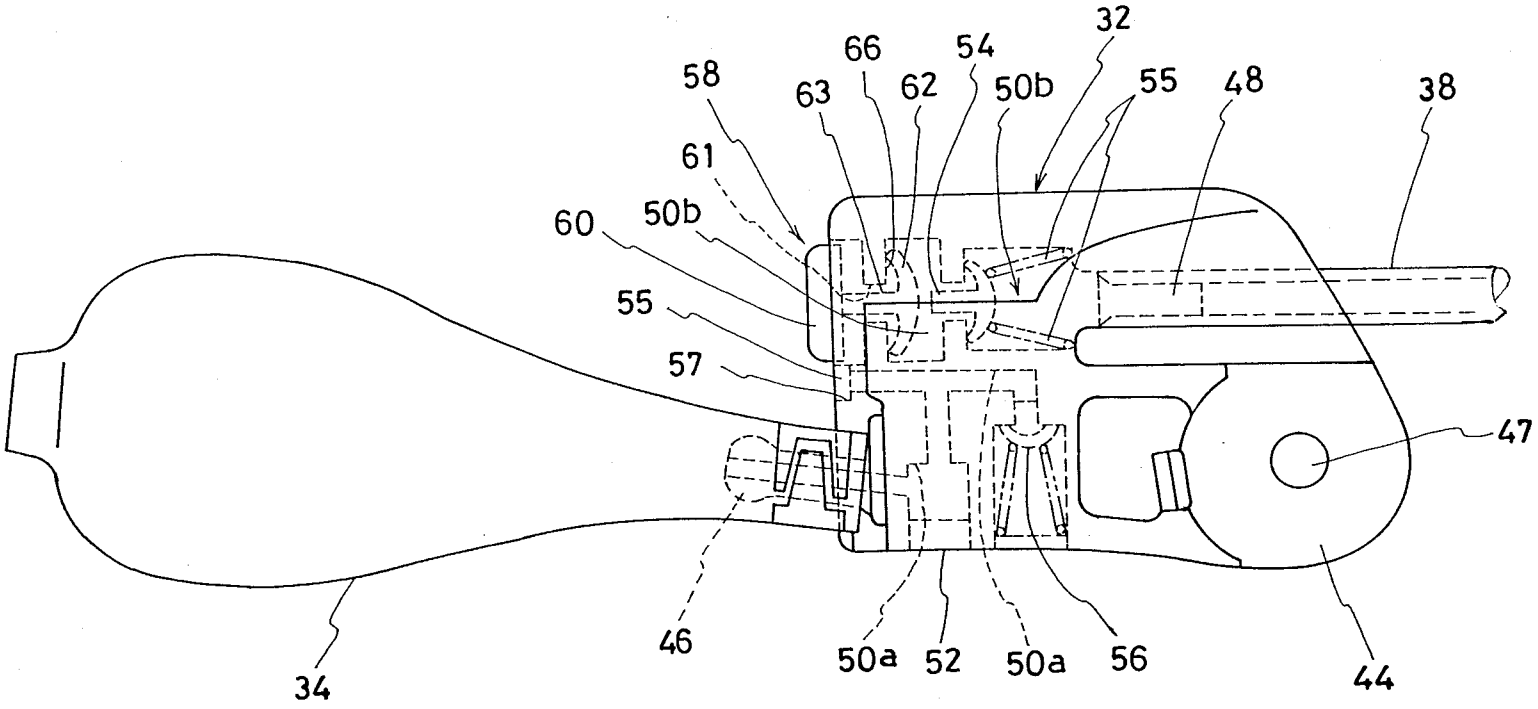
FIG. 3 is a side-sectional view of the air pump and the valve mechanism, as shown generally in FIG. 2.

In accordance with the present invention and as shown in FIGS. 2 and 3, the valve mechanism 32 contains a housing 44 and generally is attached to a base frame 45 of the vehicle seat 24 by attaching means 47, such as a rivet. The housing 44, which preferably is formed of plastic, includes entry and outlet ports 46, 48.

The air pump 34 is directly connected to the entry port 46 The tube 38 extends between the outlet port 48 and the inlet portion 26 of the inflatable chamber 28. The entry and outlet ports 46, 48 are interconnected by first and second air passages 50*a*, 50*b* extending within the housing 44. The first and second air passages 50*a*, 50*b* are connected (not shown). A first plug 52 seals a first opening 53 in the housing 44, while a second plug 55 seals a second opening 57.

As embodied herein, the valve mechanism 32 includes a check valve 54 disposed between the entry port 46 and the outlet port 48 along the second air passage 50*b*. The check valve 54 opens in response to air pressure passing through the entry port 46 and is biased to be closed by spring members 55. A relief valve 56 is disposed within the air passage 50*a* and is vented to the atmosphere. When the air pressure within the first and second air passages 50*a* and 50*b* exceeds a predetermined value, i.e., if the inflatable chamber 28 is too full, the relief valve 56 is opened and the air vents to the atmosphere.

As embodied herein, the valve mechanism 32 includes switch means mounted in the housing 44. The switch means 58 contains a knob 60 projecting out of the housing 44 through a release passage 61 connecting the air passage 50*b* and the atmosphere. The switch means also includes a valve member 62, which is integrally connected by a valve stem 63 to the knob 60, and positioned against a valve seat 66 when air is pumped into the inflatable chamber 28, thereby closing air release passage 61. The switch means 58 extend into the second air passage 50*b* for engagement with the check valve 54.

Further, when bias of the check valve 54 is overcome and the check valve 54 is unseated, air passes to the tube 38 and into the inflatable chamber 28. If the air pressure within the first and second air passages 50*a* and 50*b* exceeds a predetermined value from operation of the air pump 34, the relief valve 56 is forced open to vent the excess air to the atmosphere. The volume of air within the inflatable chamber 28, on the other hand, is controlled by depression of the knob 60, causing the valve member 62 to be moved away from the valve seat 66 to engage and open the check valve 54. Opening the check valve 54 causes the inflatable chamber 28 to be vented to the atmosphere through the release passage 61, enabling the air within the inflatable chamber 28 to be exhausted in a controllable manner.

As embodied herein, the air pump 34 is vented to the atmosphere and has a check valve (not shown), which is formed of flexible material. Accordingly, compression of the air pump 34 supplies air to the valve mechanism 32 through the inlet port 46.

In accordance with the present invention, the entry and outlet ports 46, 48 are positioned at opposite ends of the valve mechanism 32. Specifically, the inlet port 46 is positioned on the lower portion of the housing 44, while the outlet portion 48 is situated on the upper portion of the housing 44. As shown in FIG. 3, the check valve 54 and the valve member 62 are aligned essentially between the outlet port 48 and the knob 60 along the upper portion of the valve mechanism 32. The entry port 46 is connected to the first air passage 50*a* along the lower portion of the valve mechanism 32. Relief valve 56, on the other hand, is positioned at the central portion of the lower portion of the valve mechanism 32.

In view of the foregoing, the valve mechanism 32 may be extremely small (FIG. 3), as only one valve mechanism 32 is required to fill a single inflatable chamber 28. Thus, the space required for the valve mechanism 32 and the air pump 34 along the side portion of the base member 45 is minimal, even if the air pump 34 is directly mounted on the valve mechanism 32. Further, since the knob 60 and the air pump 34 are connected directly to the valve mechanism 32, the intake and exhaust of air is regulated easily by one arm of the seated passenger.

The operation of the air-controlled lumbar support apparatus of the present invention will now be described in detail with reference to the Figures. The present invention allows the air pump 34 to be compressed, thereby supplying air to the valve mechanism 32 through the entry port 46. The air is transmitted through the first and second air passages 50*a* and 50*b* of the valve mechanism 32 to open the check valve 54. Thereafter, the air is supplied from the outlet port 48 to the inflatable chamber 28 through the tube 38 to expand the inflatable chamber 28. When the inflatable chamber 28 is sufficiently filled with air, the valve member 62 may be opened by depression of knob 60 to regulate the amount of air in the inflatable chamber 28. Depression of the knob 60 forces the valve member 62 against the check valve 54. Air is passed through the check valve 54 and vented to the atmosphere through the release passage 51, when the valve member 62 is opened by depression of knob 60, thereby deflating the inflated chamber 28. Consequently, the air chamber 28 can be expanded to a desired shape and firmness by operating the air pump 34 and the knob 60, enabling the seated passenger to control the lumbar support device as desired.

According to the present invention, the air-controlled lumbar support device includes one inflatable chamber 28 installed in the backrest 30 of the vehicle seat 24, while the air pump 34 is mounted on the valve mechanism 32 for controlling the intake and exhaust of air within the inflatable chamber 28. Therefore, a single tube 38 is required to connect the inflatable chamber 28 to the valve mechanism 32, thus simplifying the construction of the tube vis-a-vis the conventional device. Importantly, the arrangement of tube 38 of the present invention prevents deformation of the tube, which is common among conventional devices.

It will be apparent to those skilled in the art that modifications and variations can be made to the air-controlled lumbar support apparatus of the present invention. The invention in its broader aspects is, therefore, not limited to the specific details, representative apparatus, and illustrative examples shown and described. Thus, it is intended that all matter contained in the foregoing description or shown in the accompanying drawings shall be interpreted as illustrative and not in a limiting sense.

What is claimed is:

1. A lumbar support device for a vehicle seat having a seat frame and a backrest comprising:

an inflatable chamber mounted within said backrest and including at least one partition;

tube means connected at one end to said inflatable chamber for transferring a flow of pressurized air to and from said inflatable chamber;

valve mechanism adapted to be attached to the seat frame and connected to another end of said tube means opposite from said end connected to said inflatable chamber, said valve mechanism including:

a housing having s base portion and an upper portion, a conduit for transferring air through said valve mechanism and into said tube means, said conduit having a first passage located along said base portion of said valve mechanism and a second passage in communication with said first passage and extending along said upper portion, a hand pump mounted on said housing along said first passage for manually pumping air into said conduit, a check valve seated within said second passage for normally restricting air from escaping from said tube means and said inflatable chamber, said check valve being unseated in response to the flow of pressurized air generated by actuation of said hand pump to permit transfer of air from said hand pump to said inflatable chamber, and a manually operable switch mounted on said housing substantially adjacent said hand pump, said switch having a control valve extending coaxially with said check valve within said second passage, said control valve being slidably positioned by depression of said switch to unseat said check valve to release air from said inflatable chamber when the amount of air within said inflatable chamber exceeds a desired level, thereby enabling regulation of the amount of air within said inflatable chamber; and a secondary relief valve mounted along said housing and adapted to exhaust air within said conduit to the atmosphere automatically when the air pressure within said conduit exceeds a predetermined pressure.

2. The lumbar support de vice as de fined in claim 1, wherein said inflatable chamber includes two partitions disposed across a substantial portion of said inflatable chamber.

3. The lumbar support device as defined in claim 1, wherein said conduit means includes an air release passage and said control valve is slidably positioned within said air release passage for engagement with said check valve.

* * * * *